US008929800B2

(12) United States Patent
Hitaka

(10) Patent No.: US 8,929,800 B2
(45) Date of Patent: Jan. 6, 2015

(54) IMAGE FORMING APPARATUS

(71) Applicant: Konica Minolta, Inc., Chiyoda-ku, Tokyo (JP)

(72) Inventor: Masatoshi Hitaka, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 23 days.

(21) Appl. No.: 13/926,958

(22) Filed: Jun. 25, 2013

(65) Prior Publication Data

US 2014/0016950 A1 Jan. 16, 2014

(30) Foreign Application Priority Data

Jul. 12, 2012 (JP) ..... 2012-156702

(51) Int. Cl.

*G03G 15/00* (2006.01)
*B65H 7/10* (2006.01)
*G03G 15/01* (2006.01)

(52) U.S. Cl.

CPC ..... *G03G 15/607* (2013.01); *G03G 15/6564* (2013.01); *G03G 15/0189* (2013.01)

USPC ..... 399/394; 399/388; 271/228

(58) Field of Classification Search

USPC ..... 399/394, 388, 395; 271/228, 241

See application file for complete search history.

(56) References Cited

U.S. PATENT DOCUMENTS

| | | | | |
|---|---|---|---|---|
| 6,741,831 | B2 * | 5/2004 | Seto | 399/388 |
| 7,664,420 | B2 * | 2/2010 | Oominami et al. | 399/85 |
| 8,205,878 | B2 | 6/2012 | Masuda | |
| 8,408,830 | B2 * | 4/2013 | Ogata et al. | 400/633 |

FOREIGN PATENT DOCUMENTS

| | | | |
|---|---|---|---|
| JP | 2008-032913 | A | 2/2008 |
| JP | 2009003095 | A | 1/2009 |
| JP | 2009-151230 | A | 7/2009 |
| JP | 2010215374 | A | 9/2010 |

OTHER PUBLICATIONS

Japanese Office Action dated Oct. 8, 2014, issued in counterpart Japanese Application No. 2012-156702.

* cited by examiner

*Primary Examiner* — Matthew G Marini
*Assistant Examiner* — Justin Olamit
(74) *Attorney, Agent, or Firm* — Holtz, Holtz, Goodman & Chick PC

(57) ABSTRACT

Provided is an image forming apparatus including an image forming unit with a plurality of developing devices, a sheet transport unit, a sheet position measurement unit that measures a position of the sheet during the transport in a direction crossing a sheet passage, a displacement correction unit that moves the sheet during the transport in the sheet-passage crossing direction to correct a displacement of the sheet, and a control unit that carries out the displacement correction for the sheet by the displacement correction unit for the measured sheet depending on the measurement result by the sheet position measurement unit if the developing device located on a upstream side is used, and carries out position correction for an image and reduces an interval of the image formation for each sheet if the developing device located on the upstream side is not used.

11 Claims, 8 Drawing Sheets

IMAGE FORMING APPARATUS

BACKGROUND OF THE INVENTION

1. Field of the Invention

The present invention relates to an image forming apparatus which forms an image on a sheet, and more particularly to an image forming apparatus which can correct a displacement of a sheet in a direction crossing a sheet passage to prepare for image formation.

2. Description of the Related Art

A latent image corresponding to an original is formed on a photoreceptor, the latent image is visualized by attaching toner thereto, and a visualized toner image is transferred to the sheet in an image forming apparatus such as a copying machine, a printer, a facsimile, and a multi-function machine having functions thereof. Then, the toner image on the sheet is fixed by a fixing unit, and the sheet is discharged.

The sheet is usually stored in a sheet feeding tray, and a sheet is fed from the sheet feeding tray by a sheet transport unit, and is transported to an image forming unit for image formation. Moreover, the sheet on which the image is formed on a front surface side is turned over by a turnover and transport unit depending on necessity to circulate the sheet to the sheet transport unit, and the image formation is carried out on a rear surface side.

When the sheets are supplied to the sheet feeding tray, if pressing by a guide plate is not proper in a direction crossing sheet-passage, or the guide plate itself is loosen due to a problem in durability and others, and the sheets are consequently not pressed properly, the sheets are displaced in a direction crossing a sheet passage in the sheet feeding tray, which appears as a displacement upon sheet feeding. Moreover, also during the sheet transport after the sheet feed, the sheet is displaced in the sheet-passage crossing direction due to a vibration, a secular degradation of components, and the like, which appears as a displacement during the transport.

Thus, factors for the displacement corrected by the resist unit and the like are mainly the two factors which are the displacement during the sheet feed, and the displacement during the sheet transport.

For the above-mentioned displacement, a displacement correction mechanism to correct the displacement by moving a sheet, which is being transported, to a reference position in a direction crossing a sheet passage direction (sheet-passage crossing direction), and determines an image write position aligned with the reference position is proposed (refer to Japanese Patent Application Laid-open No. 2008-32913). The correction mechanism according to Japanese Patent Application Laid-Open No. 2008-32913 passes multiple sheets to automatically calculate the reference position thereby reducing a load imposed on the displacement correction, and is intended to increase productivity.

Moreover, according to Japanese Patent Application Laid-Open No. 2009-151230 carries out the displacement correction by means of an image shift, and the image shift does not calculate a correction quantity for an image with respect to a present sheet, but calculates the correction quantity from an average of detected quantities of the displacement of sheets up to one sheet before to enable the image shift.

As mentioned above, as the method of correcting the displacement of the sheet, there are the method of mechanically shifting the sheet depending on the correction quantity, and the method of shifting an image to be formed depending on the correction quantity.

The sheet shift by the first method needs to mechanically shift the sheet during a period corresponding to a sheet interval, and the interval between the sheets is increased a little so that the sheet shift operation is not delayed, which leads to a decrease in productivity. According to Japanese Patent Application Laid-Open No. 2008-32913, though the productivity is tried to be increased by combination with the image shift, the increase in productivity is limited, and the productivity is not sufficiently increased.

On the other hand, though image shift by the second method does not affect the productivity, the correction quantity needs to be calculated before the image formation starts. Therefore, the detection of the displacement quantity of the shift needs to be provided on a considerably more upstream side in the sheet transport direction compared with the sheet shift by the first method. If the transport after the detection extends over a long distance, a displacement may be generated during the transport, which leads to a decrease in accuracy of the displacement detection. According to Japanese Patent Application Laid-Open No. 2009-151230, the correction quantity is calculated from the average of the detected quantities of the displacement up to the one sheet before, the displacement quantity of the present sheet is not correctly recognized, and reliability of correction is inferior.

SUMMARY OF THE INVENTION

The present invention is devised in view of the foregoing problems, and has objects to provide an image forming apparatus which can accurately correct the displacement of the sheets, and can also increase productivity of the apparatus.

In order to realize at least one of the above-mentioned objects, an image forming apparatus reflecting one aspect of the present invention includes an image forming unit that forms an image on a sheet, a plurality of developing devices that are provided for the image forming unit, a sheet transport unit that transports the sheet, a sheet position measurement unit that measures a position of the sheet during the transport in a direction crossing a sheet passage, a displacement correction unit that moves the sheet during the transport in the sheet-passage crossing direction to correct a displacement of the sheet in preparation for the image formation, and a control unit that can control the image formation and the displacement correction to provide control which receives a measurement result by the sheet position measurement unit, and moves the sheet to a predetermined position in the sheet-passage crossing direction depending on the measurement result by using the displacement correction unit, and control which receives a measurement result by the sheet position measurement unit, and moves an image forming position in a main scan direction in the image formation depending on the measurement result, where the control unit, upon the image formation, receives the measurement result by the sheet position measurement unit, and determines a sheet movement quantity by the displacement correction unit for the measured sheet depending on the measurement result to carry out the displacement correction for the sheet if the developing device located on an upstream side is used, and receives the measurement result by the sheet position measurement unit, and determines the image forming position for the measured sheet depending on the measurement result, carries out the position correction for the image, and further relatively decreases an interval for the image formation for each of the sheets compared with the case where the developing device located on the upstream side is used if the development device located on the upstream side is not used.

In the image forming apparatus according to the above-mentioned invention, the control unit preferably includes a full color mode which uses the developing device located on the upstream side, and a monochrome color mode which does not use the developing device located on the upstream side.

In the image forming apparatus according to the above-mentioned invention, the control unit preferably moves the displacement correction unit to an initial position after the displacement correction if the sheet is moved to the predetermined position in the direction crossing a paper passage by the displacement correction unit.

In the image forming apparatus according to the above-mentioned invention, the control unit preferably moves the displacement correction unit to the initial position in preparation for the displacement correction for a next sheet during the transport of the next sheet if an image of the next sheet uses the developing device located on the upstream side, and does not carry out the operation to move the displacement correction unit to the initial position during the transport of the next sheet if the image of the next sheet does not use the developing device located on the upstream side.

In the image forming apparatus according to the above-mentioned invention, the control unit preferably starts the image formation on the sheet before the sheet position measurement unit measures the position of the sheet when the control unit uses the developing device located on the upstream side.

In the image forming apparatus according to the above-mentioned invention, the control unit preferably starts the image formation on the sheet after the sheet position measurement unit measures the position of the sheet if the control unit does not use the developing device located on the upstream side.

In the image forming apparatus according to the above-mentioned invention, developing devices for at least four colors: yellow (Y), magenta (M), cyan (C), and K (black) are preferably provided as the developing devices and the developing device for the K color is located on a downstream side.

In the image forming apparatus according to the above-mentioned invention, the control unit does not preferably carry out the correction of the position of the image depending on the measurement result by the sheet position measurement unit for the measured sheet if the control unit uses the developing device located on the upstream side upon the image formation.

In the image forming apparatus according to the above-mentioned invention, the control unit preferably controls the transport of the sheet depending on the interval of the image formation.

BRIEF DESCRIPTION OF THE DRAWINGS

The present invention will be fully understood by the following detailed description and the accompanying drawings, which are not, however, intended to limit the present invention.

DETAILED DESCRIPTION OF THE PREFERRED EMBODIMENTS

A description will now be given of an embodiment according the present invention referring to accompanying drawings.

Figure 1:
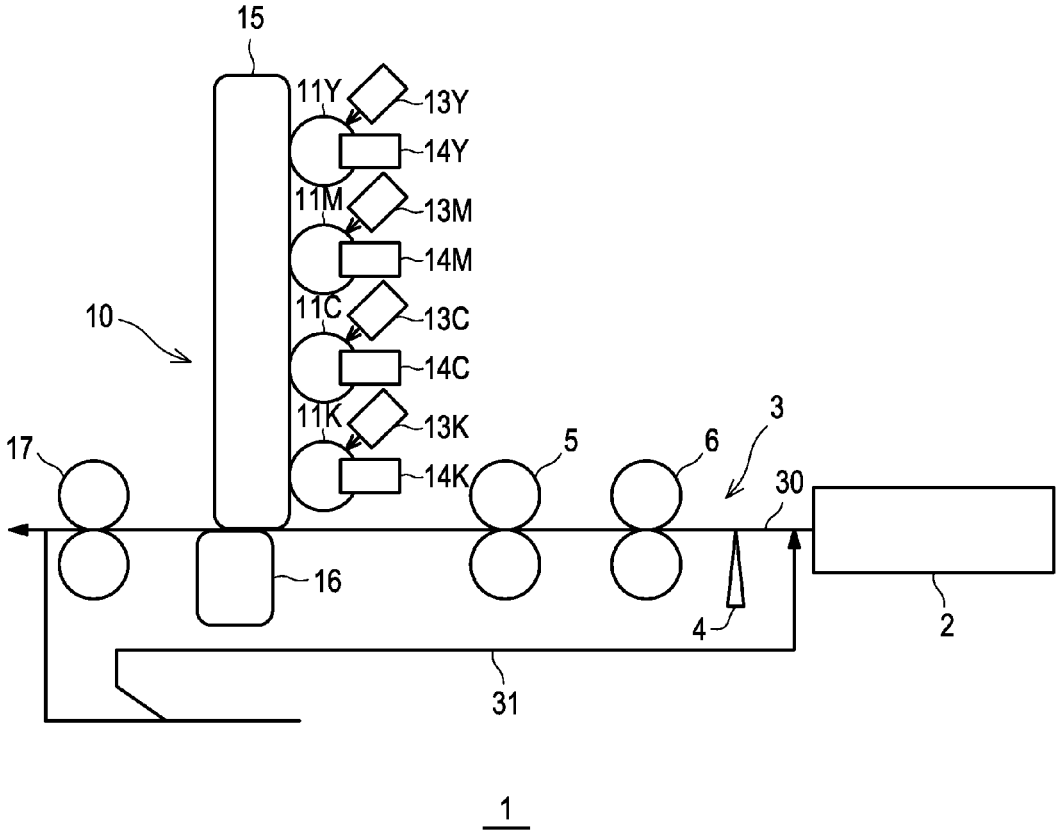
FIG. 1 is a diagram showing an overview of a mechanical configuration of an image forming apparatus according to an embodiment of the present invention.

FIG. 1 shows a schematic mechanical configuration of an image forming apparatus. A description will now be given of the configuration.

The image forming apparatus 1 includes a sheet feeding tray 2 for storing sheets, a sheet transport unit 3 for transporting the sheet fed from the sheet feeding tray 2, and an image forming unit 10 for forming an image, and transferring the image to the sheet during the transportation.

The sheet transport unit 3 includes a transport path 30 extending from the sheet feeding tray 2 to the image forming unit 10, and further to a sheet discharge side, and a turnover and transport path 31 for turning over the sheet on a downstream side of the image forming unit 10, and returning the sheet to an upstream side of the image forming unit 10 is provided on the transport path 30.

The image forming unit 10 includes photoreceptors 11Y, 11M, 11C, and 11K (generally referred to as the photoreceptors 11 hereinafter) respectively provided for yellow (Y), magenta (M), cyan (C), and black (K), and writing units 13Y, 13M, 13C, and 13K (generally referred to as writing units 13 hereinafter) constructed by electrifiers and LDs, which are not shown, and developing devices 14Y, 14M, 14C, and 14K (generally referred to as developing devices 14 hereinafter) are arranged on peripheries of the respective photoreceptors 11Y, 11M, 11C, and 11K.

The writing unit 13 carries out image exposure (image writing) based on image information on an original on a surface of the photoreceptor 11 electrified by the electrifier to form a latent image on the photoreceptor 11. The latent image is developed into a toner image by the developing device 14. The toner images are transferred to an intermediate transfer belt 15 in an order in color of Y, M, C, and K in a case of the full color mode, and the toner image only in the color K is developed by the developing device 14K, and is transferred to the intermediate transfer belt 15 in a case of the monochrome color mode.

The sheet transported at a predetermined speed on the transport path 30 is adjusted in a transport timing by the resist rollers 5 depending on the rotation of the intermediate transfer belt 15, then the transport of the sheet is started at the predetermined speed, and the images on the intermediate transfer belt 15 are transferred to the sheet on a secondary transfer belt 16.

Moreover, the sheet on which fixing has been carried out is lead from a fixing device 17 to the turnover and transport path 31 to turn over the sheet, is further led to the transport path 30 to form an image on the rear side of the sheet.

It should be noted that each of the photoreceptors 11 is driven by a drive motor, which is not shown, to rotate at a predetermined speed, and the intermediate transfer belt 15 is also driven by a drive motor, which is not shown, to rotate at a predetermined speed.

A displacement detection sensor 4 for detecting a displacement of a sheet in a direction crossing a sheet passage (direction orthogonal to a sheet passage direction in this embodiment) of the sheet transported on the transport path 30 is further disposed on the transport path 30. A proper line sensor arranged along the sheet-passage crossing direction or the like is used as the displacement detection sensor 4, and an output thereof is transmitted to a control unit mentioned later. The displacement detection sensor 4 corresponds to a sheet position measurement unit according to this embodiment. It should be noted that the configuration of the sheet position measurement unit is not limited to a specific configuration such as the displacement detection sensor 4 or the like, and may be any configuration as long as the configuration can measure the displacement of the sheet according to this embodiment.

A pair of resist rollers 5 against which a leading end of the sheet is abutted to determine a transport timing is further arranged downstream of the displacement detection sensor 4 and upstream of the image forming unit 10 on the transport path 30. Moreover, a pair of loop rollers 6 for forming a loop on the sheet which is abutted against the resist rollers 5 to correct a tilt of the sheet is arranged on the upstream side of the resist rollers 5. The resist rollers 5 and the loop rollers 6 construct a resist unit.

It should be noted that the pair of resist rollers 5 can be pressed against each other, and can be released, and the rollers can further be moved in the sheet-passage crossing direction (direction orthogonal to the sheet passage direction in this embodiment) while the rollers are pressed against each other to change the position of the sheet clamped between the rollers in the sheet-passage crossing direction in the resist unit. Namely, the resist unit corresponds to a displacement correction unit.

The sheet stored in the sheet feeding tray 2 is fed, the displacement of the sheet is detected by the displacement detection sensor 4, and the sheet then passes through the resist rollers 5, and is transported to the secondary transfer belt 16 on the transport path 30. The color images or the monochrome image on the intermediate transfer belt 15 are transferred to the sheet on the secondary transfer belt 16. The toner image on the sheet is fixed by the fixing device 17 for applying heat and a pressure to the sheet on which the images are transferred.

Figure 2:
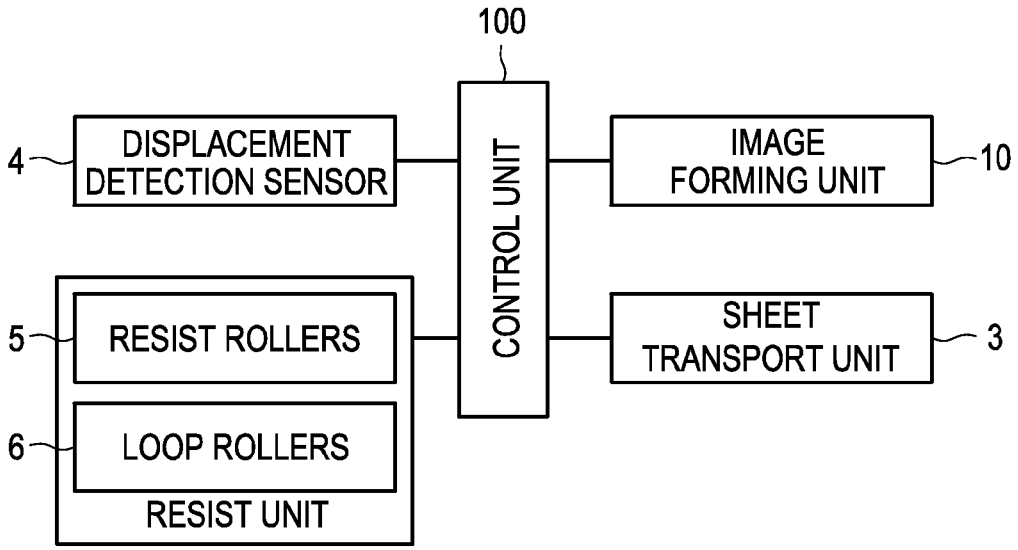
FIG. 2 is a control block diagram according to the embodiment of the present invention.

FIG. 2 shows a part of a control block of the image forming apparatus 1. A detailed description will now be given of contents thereof.

The image forming apparatus 1 includes the control unit 100 for controlling the entire image forming apparatus 1, and the control unit can be mainly constructed by a CPU and a program operating the CPU. Moreover, the control unit 100 can include a storage unit such as a nonvolatile memory for storing process parameters and the like, a RAM serving as a work area, and a ROM for storing the program and the like. Data stored in the storage unit can be read by the control unit 100, and the control unit 100 can write data in the nonvolatile memory and the RAM.

The image forming unit 10 is connected to the control unit 100 for control. The control unit 100 transmits write data to the image forming unit 10 based on image data to control the image formation. On this occasion, the timing to write an image and the position to write the image are set. An initial position for the write position is set in advance, and setting data therefor is stored in the nonvolatile memory or the like.

Moreover, the sheet transport unit 3 is connected to the control unit 100 for control. The control unit 100 controls the transport of the sheet in the sheet transport unit 3.

The resist unit including the resist rollers 5 and the loop rollers 6 is further connected to the control unit 100 for control. The control unit 100 controls the stop and the rotation of the resist rollers 5, and further controls an operation time of the loop rollers 6 after a sheet abuts against the resist rollers 5. The control unit 100 further determines a transport start timing in the resist rollers 5, and instructs the transport start timing. Moreover, the resist rollers 5 can be pressed against each other and released from each other, and the resist unit can further be moved in the sheet-passage crossing direction (direction orthogonal to the sheet passage direction in this embodiment) while the sheet is pressed to change the position of the sheet. Namely, the resist unit corresponds to the displacement correction unit. It should be noted that the displacement correction unit is not limited to the resist unit.

The displacement detection sensor 4 is connected to the control unit 100, and a detection result by the displacement detection sensor 4 is transmitted to the control unit 100.

The control unit 100 receives the detection result by the displacement detection sensor 4, calculates a sheet displacement quantity, and determines a correction quantity based on the sheet displacement quantity. The correction quantity can be a quantity of the displacement of the sheet to be corrected by the resist unit, a quantity of the displacement of the image to be corrected with respect to the image forming unit 10, or a combination thereof.

Figure 3:
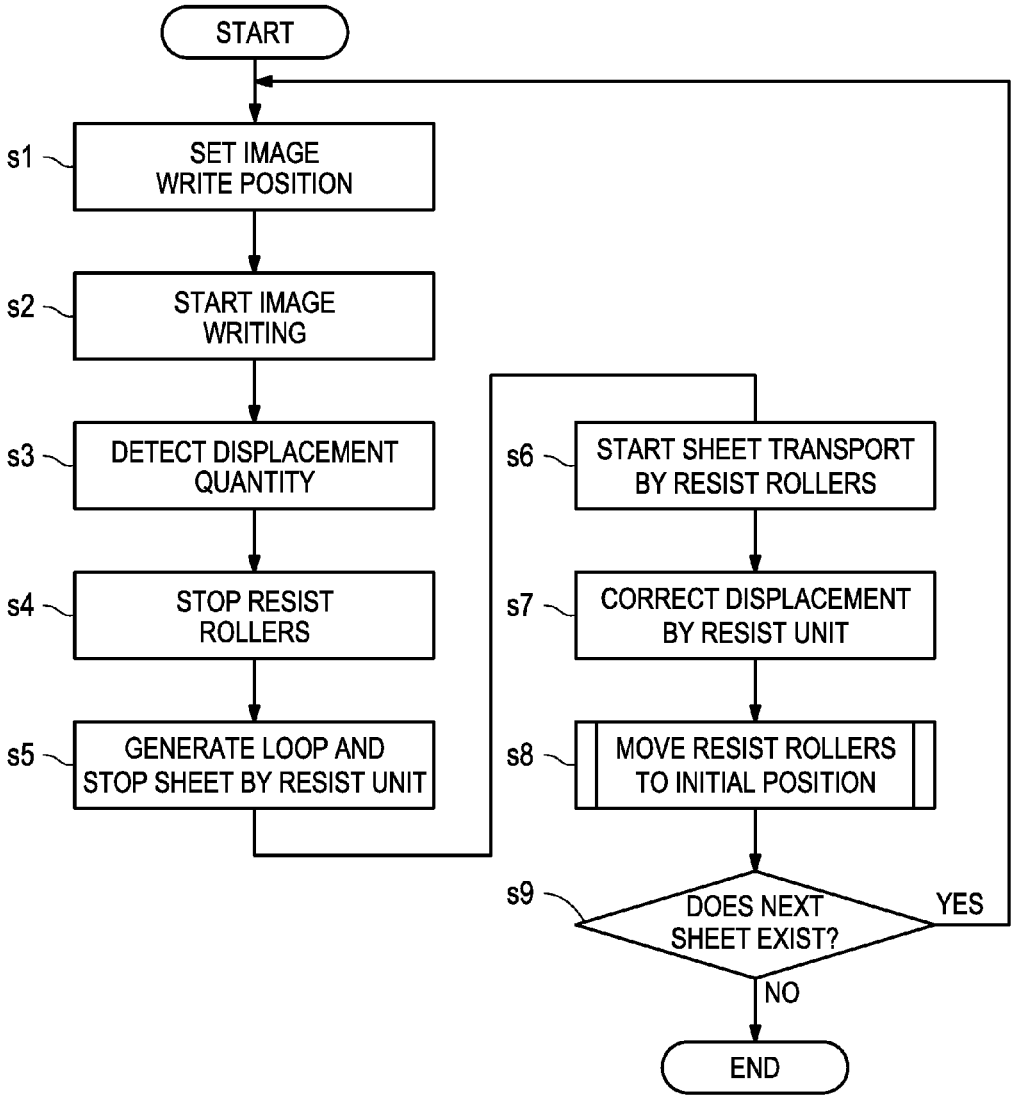
FIG. 3 is a flowchart showing a processing sequence during a full color mode operation according to the embodiment of the present invention.

A description will now be given of control for an operation with the displacement correction in the full color mode referring to a flowchart in FIG. 3. It should be noted that the following control is carried out by the control unit 100.

When print processing starts, the control unit 100 instructs the image forming unit 10 on an image write position on a sheet based on image data (Step s1), and starts the image writing by the image forming unit 10 (Step s2). It should be noted that the sheet is fed from the sheet feeding tray 2, and is being transported by the sheet transport unit 3 as a result of the start of the processing, and the displacement quantity of the sheet being transported is detected by the displacement detection unit 4 (Step s3). A detection result is transmitted to the control unit 100. The control unit 100 calculates the correction quantity for the displacement of the sheet based on the displacement quantity.

As mentioned above, the image writing is carried out in a timing before the displacement detection (Step s3) with respect to the movement of the resist rollers 5. The image write position is a predetermined position independently of the displacement quantity detection.

The resist rollers 5 are stopped after the displacement detection (Step s4). The sheet being transported abuts at a leading end against the stopped resist rollers 5, and forms a loop of a predetermined quantity as a result of the operation of the loop rollers 6, and stops (Step s5). The loop quantity is set in advance, and setting data thereof is stored in the nonvolatile memory or the like. The control unit 100 reads the setting data to control the resist unit.

The control unit 100 then starts the sheet transport by using the resist rollers 5 based on a set transport start timing (Step s6). The transport start timing is stored in the nonvolatile memory or the like, and is read by the control unit 100. Alternatively, the transport timing may be calculated upon the image formation.

Further, the control unit 100 corrects the displacement of the sheet by the movement of the resist rollers 5 in the sheet-passage crossing direction in the resist unit (Step s7). The displacement correction quantity has been calculated by the control unit 100 as mentioned before, a movement quantity of the resist unit is set by the control unit 100 based on the correction quantity, and the resist unit is controlled.

The control unit 100 carries out processing of moving the resist rollers 5 to the initial position in preparation for the displacement correction for the next sheet after the correction of the displacement of the sheet (Step s8).

The control unit 100 determines whether a next sheet exists or not after the resist rollers 5 have moved to the initial position (Step s9), if a next sheet exists (YES in Step s9), the control unit 100 returns to Step s1, repeats the same processing, and if a next sheet does not exist (NO in Step s9), the control unit 100 finishes the processing.

Though the image write position setting (Step s1) and the start of image writing (Step s2) are described as the steps before the displacement quantity detection (Step s3) in this example for the sake of convenience, the timing for writing the image varies depending on the size of the sheet, and may be carried out between the displacement quantity detection (Step s3) for the previous image and the initial position movement of the resist rollers (Step s8).

A description will now be given of the processing of moving the resist unit to the initial position after the displacement correction for the sheet referring to a flowchart in FIG. 4.

The control unit 100 waits for the arrival of the sheet at the secondary transfer belt 16 (Step s8-1), and releases the pressing of the resist rollers 5 upon the arrival (Step s8-2). In this example, the release takes 70 milliseconds. The control unit 100 then returns the resist unit to the initial position (Step s8-3). This operation takes 80 milliseconds. The control unit 100 presses the resist rollers 5 against each other in preparation for the next sheet (Step s8-4), and finishes the processing. The pressing operation takes 100 milliseconds.

Though the operation of returning the resist unit to the initial position is carried out after the displacement of the sheet is corrected in this example, the position to return the resist unit may be set to a position other than the initial set position. For example, an average or a deviation may be obtained based on a tendency in the displacement quantity to define a place which can reduce the quantity of movement of the resist unit as the initial position, and the resist unit may be returned to the initial position after the correction of the displacement.

Moreover, though only the displacement correction of moving the sheet corresponding to the displacement quantity of the sheet is carried out in this example, the forming position of an image may be shifted based on an average of the displacement quantities up to the previous sheet or the like so that the displacement is additionally corrected by the shift. The displacement correction for the sheet depending on the measured displacement quantity is not carried out on the sheet to be corrected also in this case. Therefore, it is not necessary to arrange the displacement detection sensor 4 on a more upstream side on the transport path 30, and the displacement detection sensor 4 can be arranged at a position close to the resist unit as long as the displacement detection is in time for the displacement correction by the resist unit.

Figure 5:
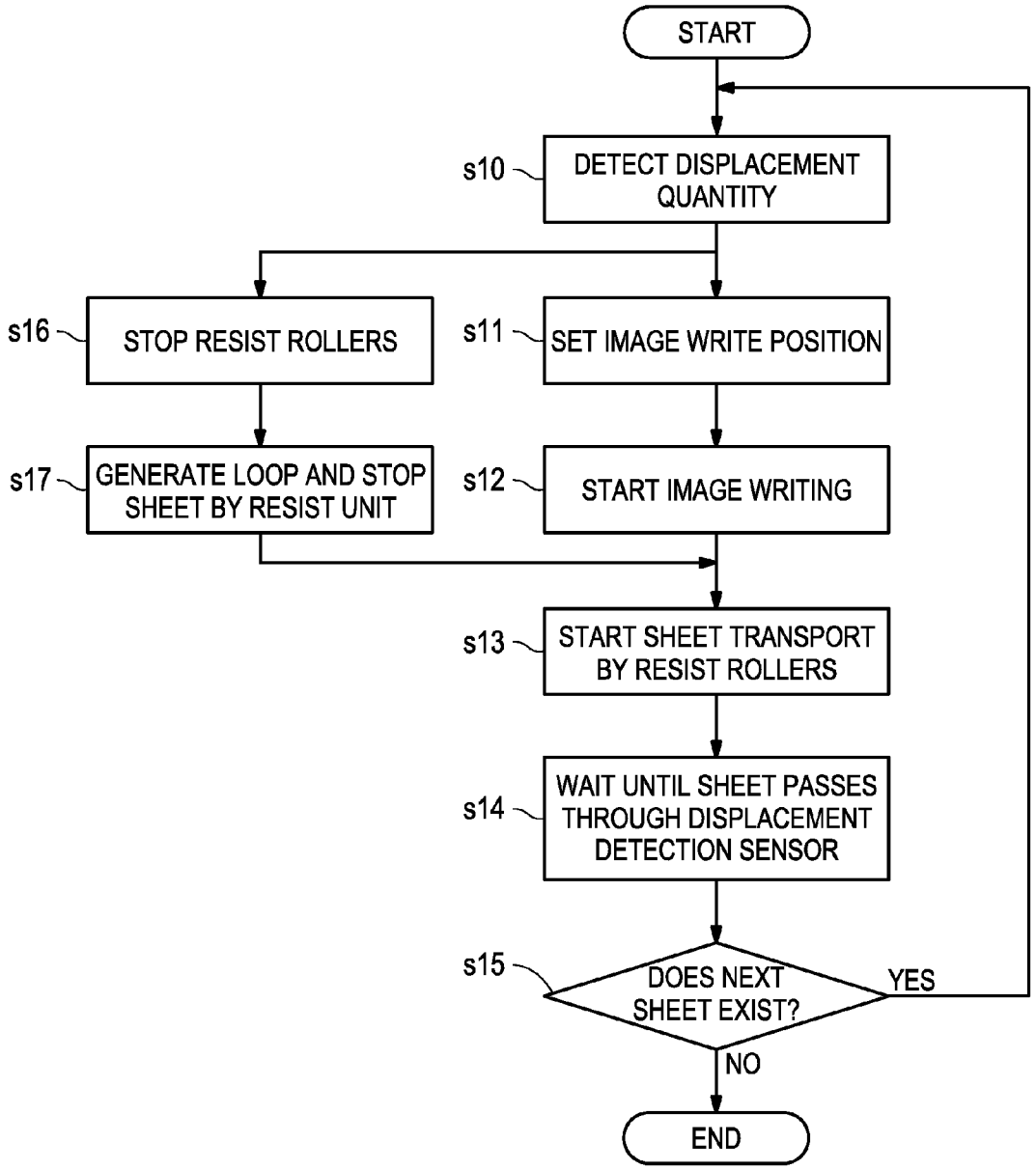
FIG. 5 is a flowchart showing a processing sequence during a monochrome mode operation according to the embodiment of the present invention.

A description will now be given of control for an operation with the displacement correction in the monochrome mode referring to a flowchart in FIG. 5. It should be noted that the following control is carried out by the control unit 100.

When the print processing starts, a sheet is fed from the sheet feeding tray 2, and is transported by the sheet transport unit 3. The displacement quantity of the sheet being transported is detected by the displacement detection sensor 4 (Step s10). A detection result is transmitted to the control unit 100. The control unit 100 calculates the write position of the image based on the displacement quantity. The write position may be an absolute position, or may be represented by a correction quantity with respect to the initially set value.

Then, the control unit 100 sets an image write position on the sheet based on the calculation result, instructs the image forming unit 10 on the position (Step s11), and starts the image writing by the image forming unit 10 (Step s12). The control unit 100 carries out processing of stopping the resist rollers 5 (Step s16), forming a loop in a predetermined quantity in the resist unit, and stopping the sheet (Step s17) in parallel with the image write position setting and the writing start.

The motion of the resist rollers 5 in this example is different from that in the full color mode, and the image writing (Steps s11 and s12) is carried out after the displacement quantity detection (Step s10). The image write position on this occasion is a position determined depending on the displacement quantity detection (Step s10).

The loop formation in the resist unit is carried out (Steps s16 and s17) in parallel with the processing for the image writing.

On this occasion, the loop formation is short in time, and is finished during the start of the image writing as in the full color mode, and the time for the loop formation does not need to be considered in the flow.

Moreover, the resist rollers 5 are stopped in a timing when a previous sheet has passed through the resist rollers 5 after the displacement quantity detection.

After the start of the image writing, the sheet transport from the resist rollers 5 starts in a predetermined transport timing (Step s13). The control unit 100 waits until the sheet has passed through the displacement detection sensor 4 (Step s14), and determines whether a next sheet following the sheet which has passed exists or not (Step s15). If there is a next sheet (YES in Step s15), the control unit 100 returns to Step s10, and repeats the same processing, and if there is not a next sheet (NO in Step s15), the control unit 100 finishes the processing.

Figure 4:
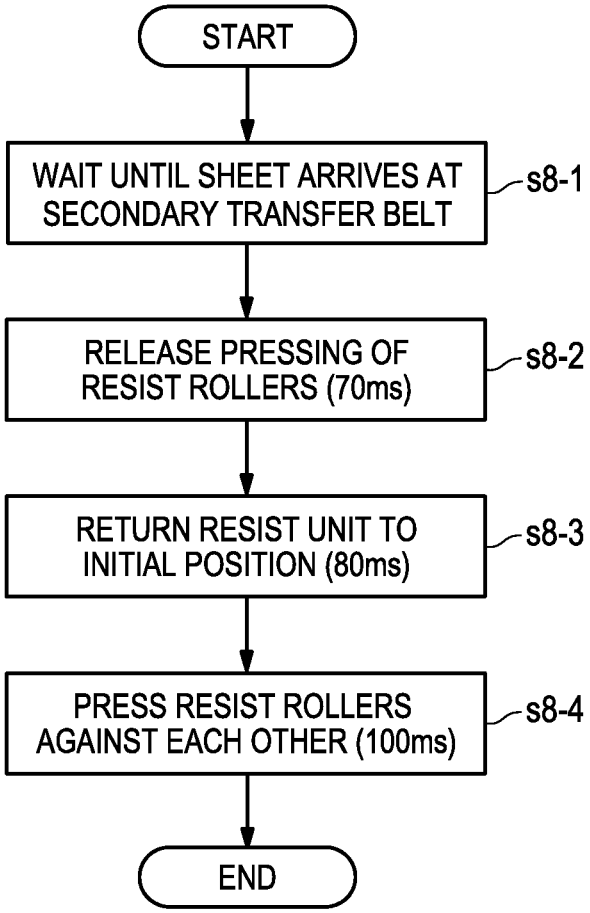
FIG. 4 is a flowchart showing a processing sequence for moving a resist unit to an initial position according to the embodiment of the present invention.

It should be noted that the resist unit does not correct a displacement, and the resist rollers 5 do not return to the initial position shown in FIG. 4 in the monochrome mode in this example. Therefore, productivity can be increased without decreasing an accuracy of the displacement correction.

A description will now be given of the productivities in the full color mode and the monochrome mode based on the following example.

The image forming apparatus 1 according to this embodiment has a distance configuration shown in TABLE 1. It should be noted that a distance from the image write position to the secondary transfer belt in the table is a travel distance of the image from the start of the write on the photoreceptors 11 to the arrival at the intermediate transfer belt.

Moreover, sheet transport speeds and an image write speed of this apparatus are shown in TABLE 2.

TABLE 1

| | |
|---|---|
| DISTANCE FROM IMAGE WRITE POSITION TO SECONDARY TRANSFER BELT IN FULL COLOR MODE | 630 mm |
| DISTANCE FROM IMAGE WRITE POSITION TO SECONDARY TRANSFER BELT IN MONOCHROME MODE | 270 mm |
| DISTANCE FROM DISPLACEMENT DETECTION SENSOR TO RESIST ROLLERS | 145 mm |
| DISTANCE FROM RESIST ROLLERS TO SECONDARY TRANSFER BELT | 140 mm |

TABLE 2

| | |
|---|---|
| SHEET TRANSPORT SPEED TO RESIST ROLLERS | 770 mm/seconds |
| SHEET TRANSPORT SPEED AFTER RESIST ROLLERS | 460 mm/seconds |
| IMAGE WRITE SPEED | 460 mm/seconds |

A time from the start of the image writing to the arrival of the image at the secondary transfer belt 16 in the full color mode from the above-mentioned points is:

630 mm÷460 mm/s=1369 milliseconds.

A time for the sheet from the resist rollers 5 to the secondary transfer belt 16 on the transport path 30 is:

140 mm÷460 mm/s=304 milliseconds.

As a result, a time from the start of the image writing to the start of the transport of the sheet by the resist rollers 5 is:

1369 milliseconds−304 milliseconds=1065 milliseconds.

The transport start timing in the resist rollers 5 is determined based on this time.

Further, if the size of the sheet is A4 on this occasion, a required time from the start of the sheet transport by the resist rollers 5 to the completion of the travel to the initial position is divided into:

the arrival time from the resist rollers 5 to the secondary transfer belt 16: 304 milliseconds the pressing release time of the resist rollers 5: 70 milliseconds the time required for returning the resist unit to the initial position: 80 milliseconds the time required to press the resist rollers against each other: 100 milliseconds Moreover, the loop quantity is set to 10 mm considering an adjustment value. A required time for attaining the adjustment value is:

10 mm÷770 mm/s(sheet transport speed)=13 milliseconds

If a control margin of the resist rollers 5 is 20 milliseconds, based on the above-mentioned values, a sheet transport cycle from the resist rollers 5 is:

587 milliseconds(sheet transport cycle)=304+70+80+100+13+20 (milliseconds).

Moreover, a cycle for enabling the image writing is not affected by the operation for the displacement correction, and is thus given by:

Cycle for enabling image writing=Sheet transport time after resist rollers+Image interval time If the image interval is 20 mm, and the sheet is A4 in size, and the transport is carried out while the longer side is at the leading end, Sheet transport time after resist rollers=210 mm(short side of *A*4)÷460 mm/second(sheet transport speed)=457 milliseconds, Image interval time=20 mm÷460 mm/second(image write speed)=43 milliseconds, and 500 milliseconds(cycle enabling image writing)=457+43 (milliseconds).

The sheet transport cycle is longer than the cycle enabling the image writing, and a final image write cycle (sheet transport cycle from the resist rollers) is 587 milliseconds, and the maximum productivity in ppm (page/minute) is represented as:

Productivity=60 seconds÷587 milliseconds=102 ppm.

The time from the start of the image writing to the arrival of the image at the secondary transfer belt 16 in the monochrome mode is:

270 mm÷460 mm/s(sheet transport speed)=587 milliseconds.

A time for the sheet from the resist rollers 5 to the secondary transfer belt 16 on the transport path 30 is:

140 mm÷460 mm/second=304 milliseconds.

As a result, a time from the start of the image writing to the start of the transport of the sheet by the resist rollers 5 is:

587 milliseconds−304 milliseconds=283 milliseconds.

The transport start timing in the resist rollers 5 is determined based on this time.

Then, a margin quantity from the displacement detection to the start of the image writing is 30 milliseconds, the time from the start of the image writing to the start of the sheet transport by the resist rollers 5 is 283 milliseconds, and a time from the start of the sheet transport by the resist rollers to the passage of the sheet through the displacement detection unit is:

(210 mm(shorter side dimension of *A*4)−145 mm)÷460 mm/second=141 milliseconds.

If the control margin in the resist rollers 5 is 20 milliseconds, a sheet transport cycle from the resist rollers 5 is:

Sheet transport cycle=30+287+141+20 (milliseconds)=478 milliseconds.

The sheet transport cycle is longer than the cycle enabling image writing acquired as mentioned above, and a final image write cycle (sheet transport cycle from the resist rollers) is 478 milliseconds, and the write interval can be smaller than that in the full color mode. The productivity (ppm (pages/minute)) is as mentioned below.

Productivity=60 seconds÷478 milliseconds=126 ppm.

Thus, the interval of writing an image can be shorter in the monochrome mode, and the productivity can thus be increased without decreasing the accuracy of the displacement correction for the sheet.

Though the description has been given of the respective pieces of processing in the full color mode and the monochrome mode, the productivity can be similarly increased without decreasing the accuracy of the displacement correction for a job where the full color mode and the monochrome mode are mixed.

Figure 6:
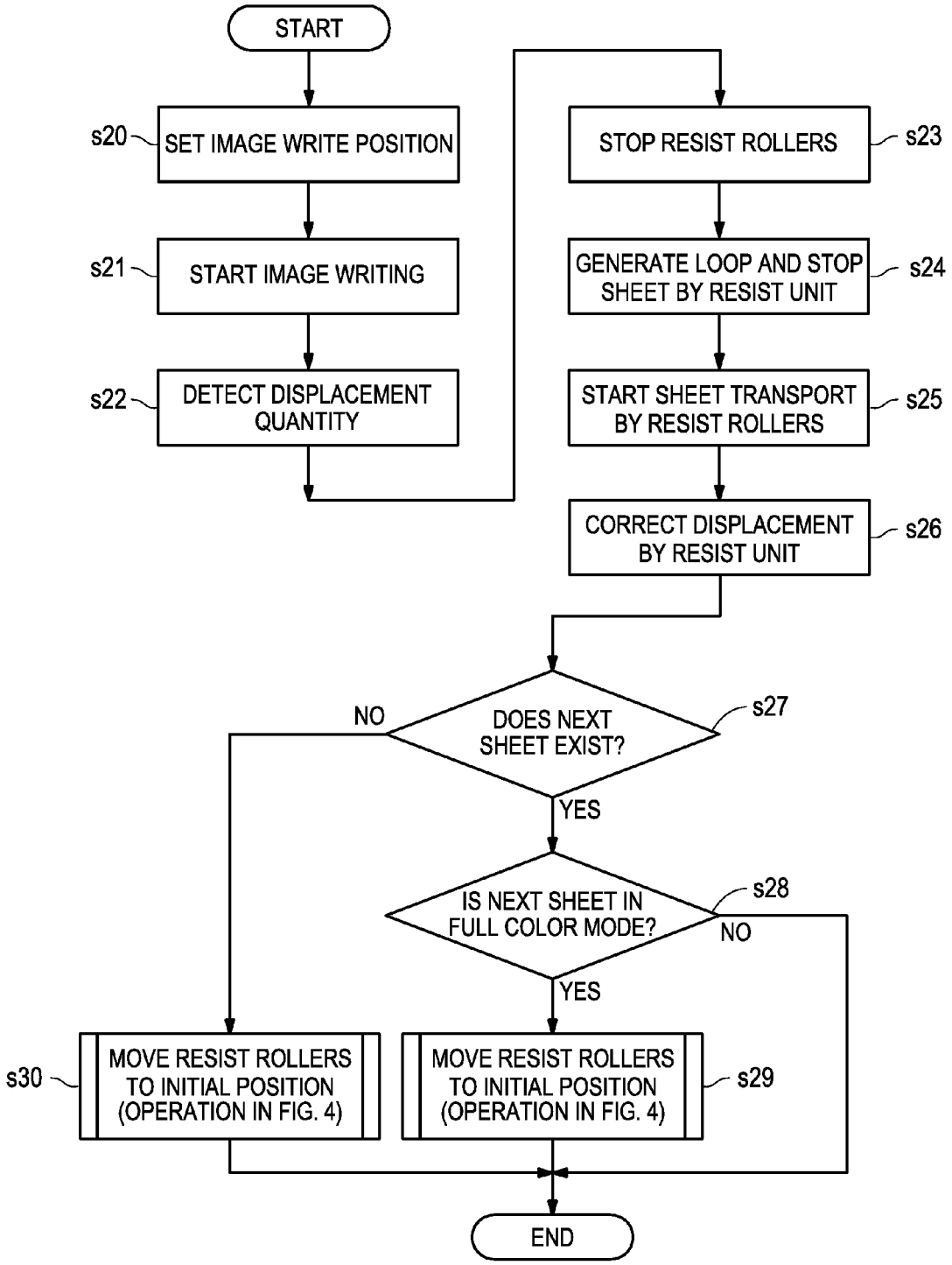
FIG. 6 is a flowchart showing a processing sequence in a full color mode when the full color mode and the monochrome mode are mixed according to the embodiment of the present invention.
Figure 7:
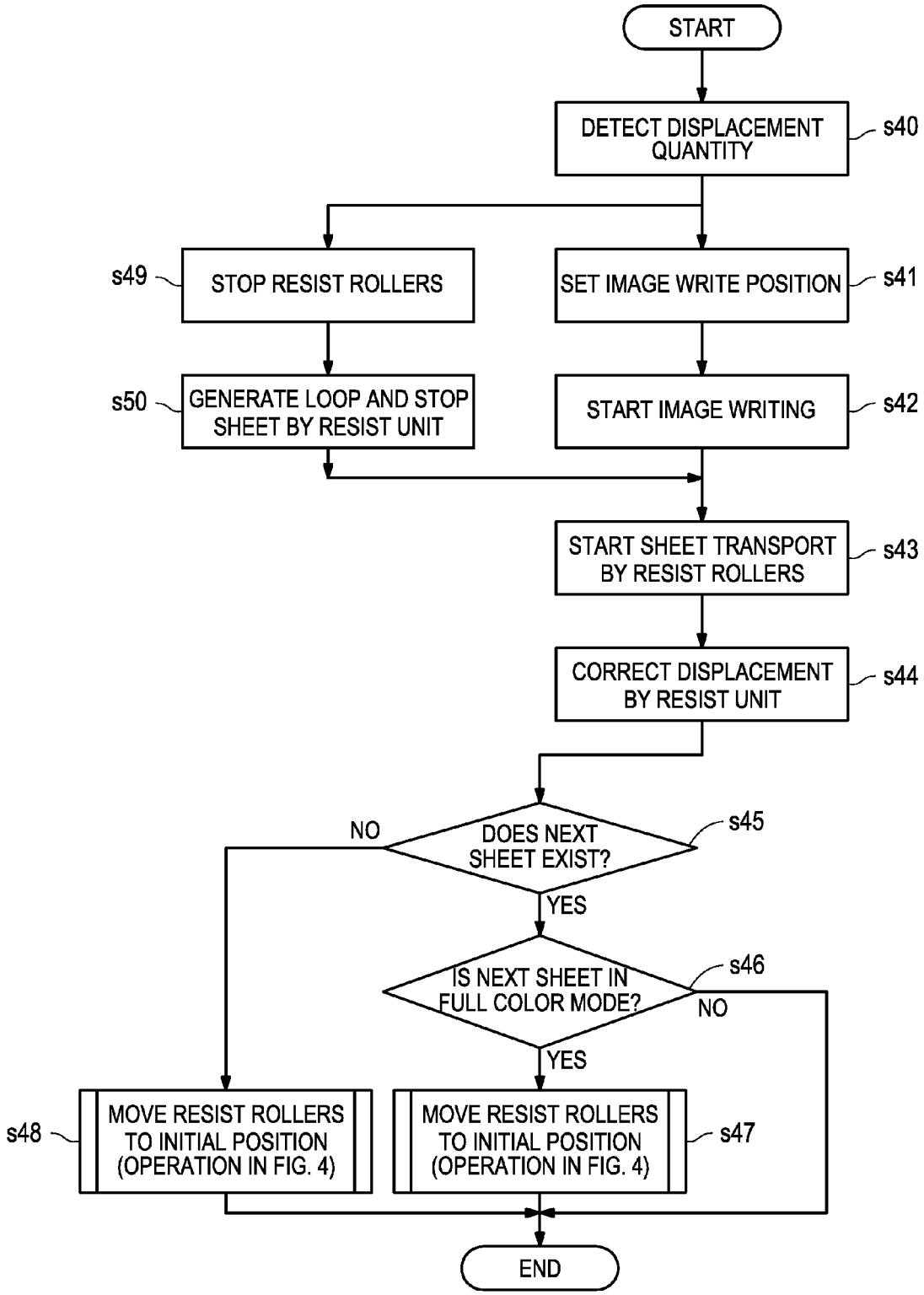
FIG. 7 is a flowchart showing a processing sequence in the monochrome mode when the full color mode and the monochrome mode are mixed according to the embodiment of the present invention.

A description will now be given of control sequences thereof referring to flowcharts in FIGS. 6 and 7.

The developing devices and the photoreceptors in four colors are kept in operation in the monochrome mode for a job including both the full color mode and the monochrome mode, and only the image write timings are changed. It should be noted that the following control is carried out by the control unit 100.

First, a description will be given of a sequence to carry out print on one sheet in the full color mode referring to FIG. 6.

When print processing starts for each sheet, the control unit 100 instructs the image forming unit 10 on an image write position on the sheet based on image data (Step s20), and starts the image writing by the image forming unit 10 (Step s21). The image write position is a predetermined position independently of the displacement quantity detection.

It should be noted that the sheet is fed from the sheet feeding tray 2, and is being transported by the sheet transport unit 3, and the displacement quantity of the sheet being transported is detected by the detection sensor 4 (Step s22). A detection result is transmitted to the control unit 100. The control unit 100 calculates the correction quantity for the displacement of the sheet based on the displacement quantity.

The resist rollers 5 are stopped after the displacement detection (Step s23). The sheet being transported abuts at a leading end against the stopped resist rollers 5, and forms a loop of a predetermined quantity as a result of the operation of the loop rollers 6, and stops (Step s24).

The control unit 100 then starts the sheet transport by using the resist rollers 5 based on a transport start timing (Step s25).

Further, the control unit 100 corrects the displacement of the sheet by the movement of the resist rollers 5 in the sheet-passage crossing direction in the resist unit (Step s26). The displacement correction quantity has been calculated by the control unit 100 as mentioned before, a movement quantity of the resist rollers 5 is controlled by the control unit 100 based on the correction quantity.

The control unit 100 determines whether a next sheet exists or not after the displacement correction (Step s27). If a next sheet does not exist (NO in Step s27), the control unit 100 carries out processing of moving the resist rollers 5 to the initial position in preparation for the displacement correction for the next sheet (Step s30). The processing sequence is the same as the flowchart shown in FIG. 4. After the processing of moving to the initial position, the control unit 100 finishes the processing in the full color mode.

If there is a next sheet (YES in Step s27), the control unit 100 determines whether the next sheet is in the full color mode or not (Step s28). The control unit 100 recognizes the mode of each sheet.

If the next sheet is not in the full color mode (NO in Step s28), the control unit 100 finishes the processing in the full color mode.

If the next sheet is in the full color mode (YES in Step s28), the control unit 100 carries out processing of moving the resist rollers 5 to the initial position in preparation for the displacement correction for the next sheet (Step s29). The processing sequence is the same as the flowchart shown in FIG. 4. After the processing of moving to the initial position, the control unit 100 finishes the processing in the full color mode.

If a next sheet exists and the next sheet is in the full color mode, the control unit 100 moves the resist rollers 5 to the initial position in preparation for the next sheet, and if the next sheet is not in the full color mode, namely in the monochrome mode, the control unit 100 does not carry out the operation to move the resist rollers 5 to the initial position in this example as mentioned above. As a result, the image formation can be carried out while the interval of the image formation is decreased in the subsequent monochrome mode.

Moreover, the forming position of an image may be shifted in addition to the correction of the sheet displacement in this example, not based on the displacement detection, but based on the average of the displacement quantity up to the previous sheet, for example.

A description will now be given of a sequence to carry out print on one sheet in the monochrome mode referring to FIG. 7. It should be noted that the following control is carried out by the control unit 100.

When the processing starts for one sheet in the monochrome mode, a sheet is fed from the sheet feeding tray 2, and is transported by the sheet transport unit 3. The displacement quantity of the transported sheet is detected by the displacement detection sensor 4 (Step s40). A detection result is transmitted to the control unit 100. The control unit 100 determines the forming position of the image based on the displacement quantity.

Then, the control unit 100 sets an image write position on the sheet based on the displacement quantity detection result, instructs the image forming unit 10 on the position (Step s41), and starts the image writing by the image forming unit 10 (Step s42). The control unit 100 carries out processing of stopping the resist rollers 5 (Step s49), forming a loop in a predetermined quantity in the resist unit, and stopping the sheet (Step s50) in parallel with the image write position setting and the writing start. The image writing (Step s42) is carried out after the displacement quantity detection (Step s40), which is different from the full color mode. The image write position on this occasion is a position determined by the displacement quantity detection (Step s40).

The loop formation in the resist unit is carried out (Steps s49 and s50) in parallel with the processing for the image writing.

The resist rollers 5 are stopped in a timing when a previous sheet has passed through the resist rollers 5 after the displacement quantity detection.

After the start of the image writing, the sheet transport from the resist rollers 5 starts in a predetermined transport timing (Step s43). Then, the control unit 100 carries out the displacement correction for the sheet by the resist unit depending on the displacement detection result (Step s44). It should be noted that the image forming position has already been corrected depending on the displacement quantity in this example, and the displacement correction of the sheet can be carried out if the displacement correction is insufficient only by the correction of the forming position of the image, or can be carried out for a small displacement quantity. Moreover, the displacement correction may be omitted.

A load imposed by the displacement correction for the sheet is small, and the operation to return the resist unit to the initial position is eliminated. Therefore, the interval of the image formation can be smaller than that in the full color mode.

The control unit 100 determines whether a next sheet exists or not after the displacement correction (Step s45). If a next sheet does not exist (NO in Step s45), the control unit 100 carries out processing of moving the resist rollers 5 to the initial position in preparation for the displacement correction for the next sheet (Step s48). The processing sequence is the same as the flowchart shown in FIG. 4. After the processing of moving to the initial position, the control unit 100 finishes the processing in the monochrome mode.

If there is a next sheet (YES in Step s45), the control unit 100 determines whether the next sheet is in the full color mode or not (Step s46).

If the next sheet is not in the full color mode (NO in Step s46), the control unit 100 finishes the processing in the monochrome mode.

If the next sheet is in the full color mode (YES in Step s46), the control unit 100 carries out processing of moving the resist rollers 5 to the initial position in preparation for the displacement correction for the next sheet (Step s47). The processing sequence is the same as the flowchart shown in FIG. 4. After the processing of moving to the initial position, the control unit 100 finishes the processing in the monochrome mode.

If a next sheet exists and the next sheet is in the full color mode, the control unit 100 moves the resist rollers 5 to the initial position in preparation for the next sheet, and if the next sheet is not in the full color mode, namely in the monochrome mode, the control unit 100 does not carry out the operation to move the resist rollers 5 to the initial position in this example as mentioned above. As a result, the image formation can be carried out while the interval of the image formation is decreased also in the subsequent monochrome mode.

The processing sequence depending on the mode of the next sheet can be carried out by the control unit 100 selecting a sequence for each sheet.

Figure 8:
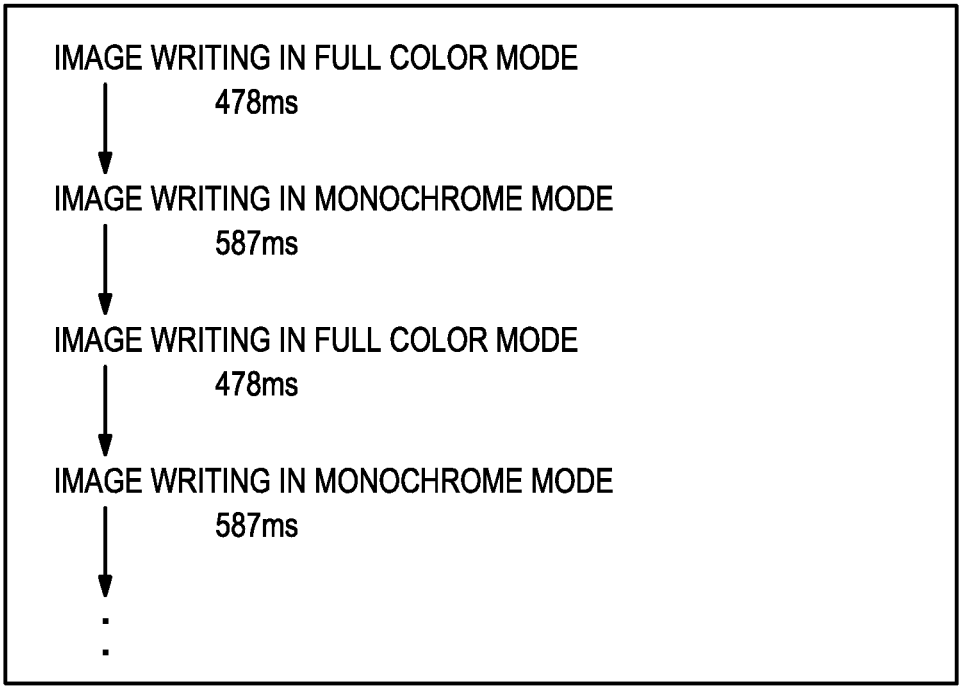
FIG. 8 is a flowchart showing an image write interval when the full color mode and the monochrome mode are mixed according to the embodiment of the present invention.

The interval for the image writing can be shorter (478 milliseconds) than the interval (587 milliseconds) in the full color mode as shown in FIG. 8 when the processing is switched from a sheet in the full color mode to a sheet in the monochrome mode for a job including both the full color mode and the monochrome mode as mentioned above, and the productivity of the entire job can thus be increased without degrading the accuracy of the displacement correction.

This embodiment can provide the effect of restraining the position accuracy of the displacement correction from reducing and restraining the productivity from reducing as mentioned above depending on whether the developing devices located on the upstream side is used or not.

Though the present invention is described based on the embodiment, the present invention is not limited to the contents of the description, and may be properly modified as long as the modification does not depart from the present invention.

The entire disclosure of Japanese Patent Application No. 2012-156702, filed on Jul. 12, 2012 including description, claims, drawings, and abstract are incorporated herein by reference in its entirety.

What is claimed is:

1. An image forming apparatus comprising:

an image forming unit that forms an image on a sheet based on image data, comprising:

a plurality of photoreceptors that each create a toner image; and an intermediate transfer belt that superimposes each toner image to create the image and then transfers the image to the sheet;

a sheet transport unit that transports the sheet in a sheet transport direction;

a sheet position measurement unit that measures a lateral displacement of the sheet;

a displacement correction unit that moves the sheet in a lateral direction perpendicular to the sheet transport direction to correct the lateral displacement of the sheet; and a control unit that determines whether the image forming unit forms the image in a multicolor mode using multiple photoreceptors or a monochrome mode using only a single receptor based on the image data, wherein in response to a determination that the image forming unit forms the image in the multicolor mode, the control unit controls the displacement correction unit to move the sheet in the lateral direction by an amount corresponding to the lateral displacement of the sheet, and in response to a determination that the image forming unit forms the image in the monochrome mode, the control unit controls the image forming unit to shift a lateral position of a toner image to be created by the single photoreceptor by an amount corresponding to the lateral displacement of the sheet without controlling the displacement correction unit to shift the lateral position of the sheet.

2. The image forming apparatus according to claim 1, wherein the control unit can carry out a job using both the full color mode and the monochrome color mode.

3. The image forming apparatus according to claim 1, wherein the control unit controls the displacement correction unit to move to an initial position after the displacement correction unit moves the sheet in the lateral direction.

4. The image forming apparatus according to claim 3, wherein the initial position is a position set depending on an initial set position of the displacement correction unit.

5. The image forming apparatus according to claim 1, wherein the control unit controls the displacement correction unit to move to the initial position in preparation for a next sheet during the transport of the next sheet if an image formation process of the next sheet uses multiple photoreceptors, and does not control the displacement correction unit to move to the initial position during the transport of the next sheet if the image formation process of the next sheet does not use multiple photoreceptors.

6. The image forming apparatus according to claim 1, wherein the control unit controls the image forming unit to start the image formation process before the sheet position measurement unit measures the position of the sheet if the image formation process uses multiple photoreceptors.

7. The image forming apparatus according to claim 1, wherein the control unit controls the image forming unit to start the image formation process after the sheet position measurement unit measures the position of the sheet if the image formation process does not use multiple photoreceptors.

8. The image forming apparatus according to claim 1, wherein developing devices for at least four colors, yellow (Y), magenta (M), cyan (C), and black (K), are provided for respective photoreceptors of the plurality of photoreceptors and a developing device and a photoreceptor for black are located on the intermediate transfer belt at a location closest to where the image is transferred from the intermediate transfer belt to the sheet.

9. The image forming apparatus according to claim 1, wherein the control unit does not control the image forming unit to shift the lateral position of the toner image if the image formation process uses multiple photoreceptors.

10. The image forming apparatus according to claim 1, wherein the control unit controls the sheet transport unit to transport the sheet depending on an interval of the image formation process.

11. The image forming apparatus according to claim 1, wherein the control unit relatively decreases an interval for the image formation for each of the sheets in the monochrome mode compared with the interval for the image formation for each of the sheets in the multicolor mode.

* * * * *